US009279644B2

(12) United States Patent
Cronk

(10) Patent No.: US 9,279,644 B2
(45) Date of Patent: Mar. 8, 2016

(54) VEHICLE

(71) Applicant: Pearson Engineering Limited, Newcastle upon Tyne (GB)

(72) Inventor: Richard Leonard Cronk, Belsay (GB)

(73) Assignee: Pearson Engineering Limited, Newcastle Upon Tyne (GB)

( * ) Notice: Subject to any disclaimer, the term of this patent is extended or adjusted under 35 U.S.C. 154(b) by 99 days.

(21) Appl. No.: 14/225,782

(22) Filed: Mar. 26, 2014

(65) Prior Publication Data

US 2015/0268012 A1 Sep. 24, 2015

(30) Foreign Application Priority Data

Mar. 27, 2013 (EP) ..... 13161276

(51) Int. Cl.

| | |
|---|---|
| ***F41F 5/00*** | (2006.01) |
| ***B64D 1/04*** | (2006.01) |
| ***F41H 11/18*** | (2011.01) |
| ***F41H 11/30*** | (2011.01) |
| ***F41H 11/26*** | (2011.01) |
| ***F41H 11/32*** | (2011.01) |

(52) U.S. Cl.

CPC ..... *F41H 11/18* (2013.01); *F41H 11/26* (2013.01); *F41H 11/30* (2013.01); *F41H 11/32* (2013.01)

(58) Field of Classification Search

CPC ..... F41H 5/0471; F41H 5/04; F41H 5/0414; F41H 5/0428; F41H 5/0442; F41H 5/0457; F41H 5/0478

USPC ..... 89/1.13; 102/402, 403

See application file for complete search history.

(56) References Cited

U.S. PATENT DOCUMENTS

| | | | | |
|---|---|---|---|---|
| 1,190,257 | A * | 7/1916 | Love | F41H 11/30 15/179 |
| 3,771,413 | A * | 11/1973 | Sieg | F41H 11/30 89/1.13 |
| 5,786,542 | A * | 7/1998 | Petrovich | F41H 11/30 89/1.11 |
| 6,182,769 | B1 * | 2/2001 | Karlen | F41H 11/26 172/122 |

(Continued)

FOREIGN PATENT DOCUMENTS

| | | |
|---|---|---|
| EP | 2 397 808 | 12/2011 |
| EP | 2397808 A1 | 12/2011 |

(Continued)

OTHER PUBLICATIONS

European Search Report mailed Aug. 30, 2013 for EP Patent Application No. 13161276.4.

(Continued)

*Primary Examiner* — Samir Abdosh

(74) *Attorney, Agent, or Firm* — Kilpatrick Townsend Stockton LLP

(57) ABSTRACT

A vehicle (2) comprising a vehicle body (6) is disclosed. First struts (16) are mounted to the vehicle body for supporting transport wheels (12) for supporting the vehicle body in a first mode of operation of the vehicle, and second struts (26) are mounted to the vehicle body for supporting roller assemblies (14) for supporting the vehicle body and applying pressure to the ground to detonate explosive devices in a second mode of operation of the vehicle. The transport wheels engage the ground and the rollers are out of engagement with the ground in the first mode, and the rollers engage the ground and the transport wheels are out of engagement with the ground in the second mode. Rollers of one roller assembly partly protrude into gaps between rollers of the other roller assembly.

14 Claims, 7 Drawing Sheets

(56) References Cited

U.S. PATENT DOCUMENTS

| | | | | |
|---|---|---|---|---|
| 7,100,489 | B1 * | 9/2006 | Kendall | F41H 11/30 172/445.1 |
| 7,685,917 | B2 * | 3/2010 | Reeves | F41H 11/24 102/402 |
| 8,763,506 | B2 * | 7/2014 | Ulrich | F41H 11/30 89/1.13 |
| 2006/0266576 | A1 * | 11/2006 | Eckhoff | B62D 49/0635 180/14.1 |
| 2008/0236376 | A1 * | 10/2008 | Reeves | F41H 11/24 89/1.13 |
| 2011/0048217 | A1 * | 3/2011 | Ulrich | F41H 11/30 89/1.13 |

FOREIGN PATENT DOCUMENTS

| | | |
|---|---|---|
| WO | WO 2004/106839 | 12/2004 |
| WO | WO 2004/106839 A1 | 12/2004 |
| WO | WO 2007/027217 | 3/2007 |

OTHER PUBLICATIONS

European Patent Office, Extended European Search Report, Application No. 13161276, dated Aug. 30, 2013.

European Patent Office, Extended European Search Report, Application No. 14161268, dated Jul. 1, 2014.

* cited by examiner

VEHICLE

CROSS-REFERENCE TO RELATED APPLICATION

This application claims priority to EP Patent Application No. 13161276.4, entitled "Vehicle," filed Mar. 27, 2013, the entirety of which is hereby incorporated by reference herein.

FIELD

The present invention relates to vehicles, and relates particularly, but not exclusively, to vehicles having interchangeable first ground engaging means for rapid movement of the vehicle and second ground engaging means for detonating explosive devices.

BACKGROUND

Apparatus for detonating explosive devices are known which comprise a ground engaging element such as a roller for applying pressure to the ground to detonate explosive devices such as mines in order to clear a track which is then safe for personnel to use on foot. Existing apparatus of this type suffers from the drawback that the complexity and mass of the ground engaging mechanism is such that movement of the vehicle can be unnecessarily slow and uncomfortable in regions in which the risk posed by explosive devices is low.

A further known vehicle is disclosed in US 2006/0266576 and has a pair of triggering modules which can be brought into contact with the ground to raise wheels of the vehicle out of contact with the ground such that the triggering modules detonate explosive devices. However, this arrangement suffers from the drawback that in the event of twisted ground surfaces, one or more of the triggering modules can reach the limit of its travel on its suspension and can thereby no longer apply force effectively to the ground.

Preferred embodiments of the present invention seek to overcome the above disadvantage of the prior art.

SUMMARY

According to the present invention, there is provided a vehicle comprising:

a vehicle body;

first ground engaging means, adapted to support the vehicle body in a first mode of operation of the vehicle;

second ground engaging means, adapted to support the vehicle body and apply pressure to the ground to detonate explosive devices in a second mode of operation of the vehicle; and support means mounted to the vehicle body for supporting the first ground engaging means and the second ground engaging means;

wherein said support means is adapted to cause said first ground engaging means to engage the ground and said second ground engaging means to be out of engagement with the ground in said first mode, and said second ground engaging means to engage the ground and said first ground engaging means to be out of engagement with the ground in said second mode, and wherein said second ground engaging means comprises at least one first row of ground engaging members and at least one second row of ground engaging members, and at least one ground engaging member of at least one said first row at least partly protrudes into a gap between a plurality of ground engaging members of a respective said second row.

By providing support means adapted to cause the first ground engaging means to engage the ground and the second ground engaging means to be out of engagement with the ground in the first mode, and the second ground engaging means to engage the ground and the first ground engaging means to be out of engagement with the ground in the second mode, this provides the advantage of enabling a first ground engaging means suitable for rapid movement of the vehicle to be used, for example ground engaging wheels having tires, or tracks, in conditions in which the risk of detonation of explosive devices is low. By providing second ground engaging means comprising at least one first row of ground engaging members and at least one second row of ground engaging members, wherein at least one ground engaging member of at least one first row at least partly protrudes into a gap between a plurality of ground engaging members of a respective second row, this provides the advantage of improving the stability and effectiveness of the vehicle for operation on uneven ground surfaces.

The support means may be adapted to raise the first ground engaging means relative to the vehicle body and/or relative to the second ground engaging means.

The support means may comprise at least one first support member adapted to be pivotably mounted relative to the vehicle body and to the first ground engaging means.

The support means may be adapted to raise the second ground engaging means relative to the vehicle body and/or relative to the first ground engaging means.

The support means may further comprise at least one second support member adapted to be pivotably mounted relative to the vehicle body and to the second ground engaging means.

The support means may further comprise at least one piston for connecting the second ground engaging means to the vehicle body and allowing movement of the second ground engaging means relative to the vehicle body.

The support means may comprise a plurality of said pistons interconnected by at least one chamber adapted to contain liquid, wherein a plurality of said pistons are adapted to connect at least one respective ground engaging member of the second ground engaging means to said vehicle body.

By providing a plurality of said pistons interconnected by at least one chamber adapted to contain liquid, wherein a plurality of said pistons are adapted to connect at least one respective ground engaging member of the second ground engaging means to said vehicle body, this provides the advantage of providing substantially the same force to each ground engaging member, thereby increasing its reliability in detonating explosive devices.

At least one first plurality of said pistons on a first side of said vehicle may be interconnected by at least one respective first said chamber, and at least one second plurality of said pistons on a second side of said vehicle may be interconnected by at least one respective second said chamber.

This provides the advantage of improving the stability of the vehicle to rolling motion.

At least one plurality of said chambers may be interconnected by hydraulic interconnection means arranged in use on an upper part of said vehicle body.

This provides the advantage of making the hydraulic interconnection means less prone to damage in the event of detonation of an explosive device.

The vehicle may further comprise third ground engaging means adapted to engage one or more wires extending laterally across the path of the vehicle.

This provides the advantage of enabling wires for operating explosive devices, for example command wires, to be located and/or disabled.

The third ground engaging means may be adapted to leave a visible trace as a result of engagement with the ground.

This provides the advantage of enabling a track cleared of explosive devices by the vehicle to be made more visible to personnel following the vehicle on foot.

The third ground engaging means may be displaceable relative to the vehicle body and may be biased into engagement with the ground in use.

This provides the advantage of enabling the third ground engaging means to remain in contact with uneven ground and/or penetrate the ground, while avoiding damage to the third ground engaging means if it engages an immoveable obstacle.

The third ground engaging means may comprise at least one first ground engaging member moveable relative to the vehicle body from a first position to a second position as a result of reversal of the direction of travel of the vehicle, wherein the first ground engaging member causes a smaller resistance to movement of the vehicle in said second position than in said first position.

This provides the advantage of minimising damage to the third ground engaging means when the vehicle is reversed.

The third ground engaging means may comprise at least one support member and at least one respective said first ground engaging member pivotably mounted to at least one said support member.

BRIEF DESCRIPTION OF THE FIGURES

A preferred embodiment of the invention will now be described, by way of example only and not in any limitative sense, with reference to the accompanying drawings, in which.

DETAILED DESCRIPTION

Figure 1:
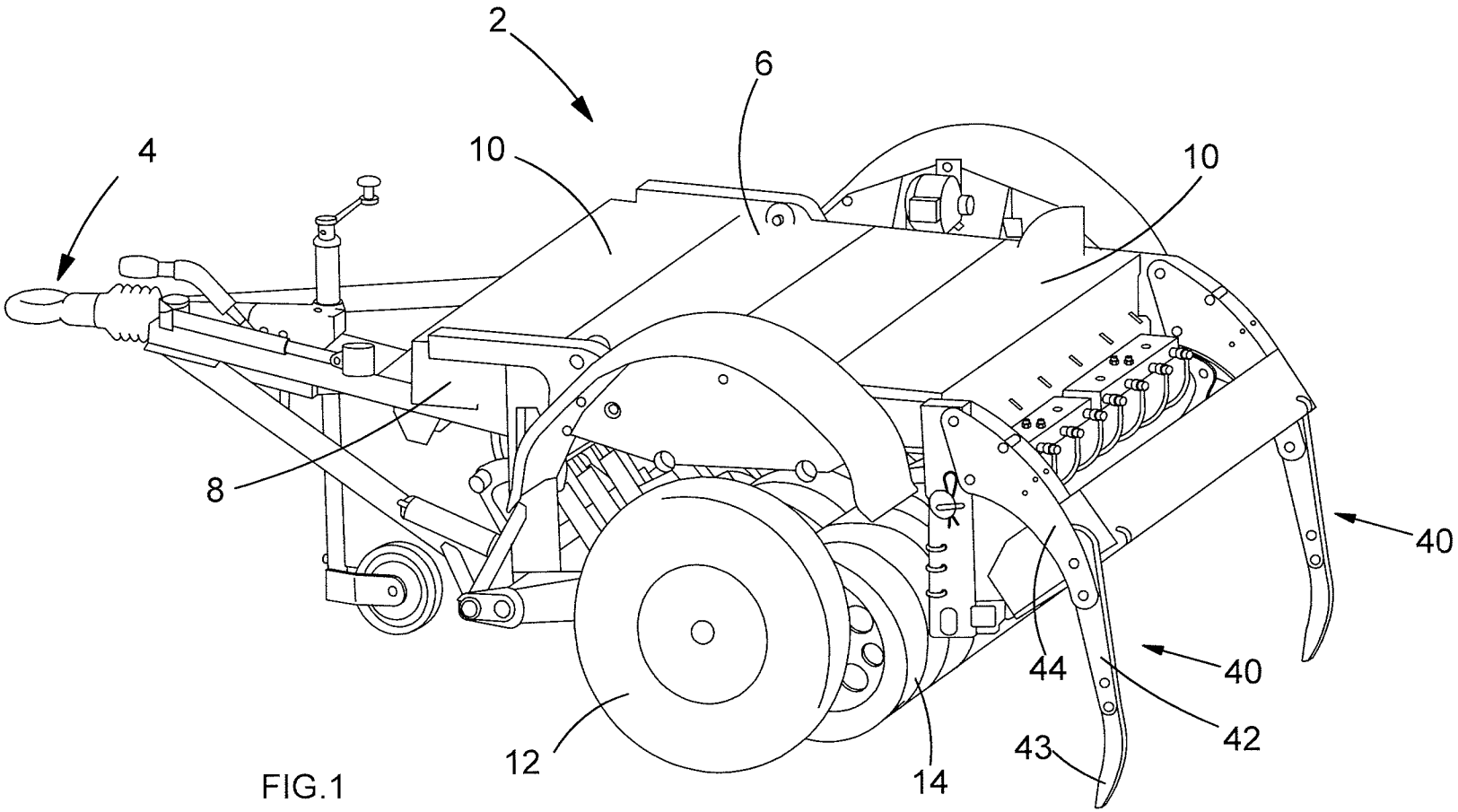
FIG. 1 is a perspective view of a vehicle embodying the present invention.

Referring to FIG. 1, a vehicle in the form of a trailer 2 is adapted to be towed by a towing vehicle (not shown) via a tow hitch 4 has a vehicle body 6 for transporting goods and having a frame 8 for accommodating ballast such as sandbags 10 for adding weight to the vehicle body 6 when it is not transporting goods, first ground engaging means in the form of transport wheels 12 which may be of generally the same type as those of the towing vehicle (not shown), and second ground engaging means in the form of two sets of ground engaging rollers 14 (shown in greater detail in FIGS. 2 and 3) for engaging the ground and detonating explosive devices (not shown) such as mines and improvised explosive devices (IEDs). The vehicle 2 is designed to operate in a first mode, in which the transport wheels 12 engage the ground and the rollers 14 are separated from the ground, to enable rapid transport of the vehicle 2, for example to transport goods supported on the vehicle body 6 when the risk of encountering explosive devices is low, and a second mode, in which the transport wheels 12 are separated from the ground and the ground engaging rollers 14 engage the ground to detonate explosive devices to clear a track behind the vehicle 2 which is then safe or personnel to use on foot.

Figure 5:
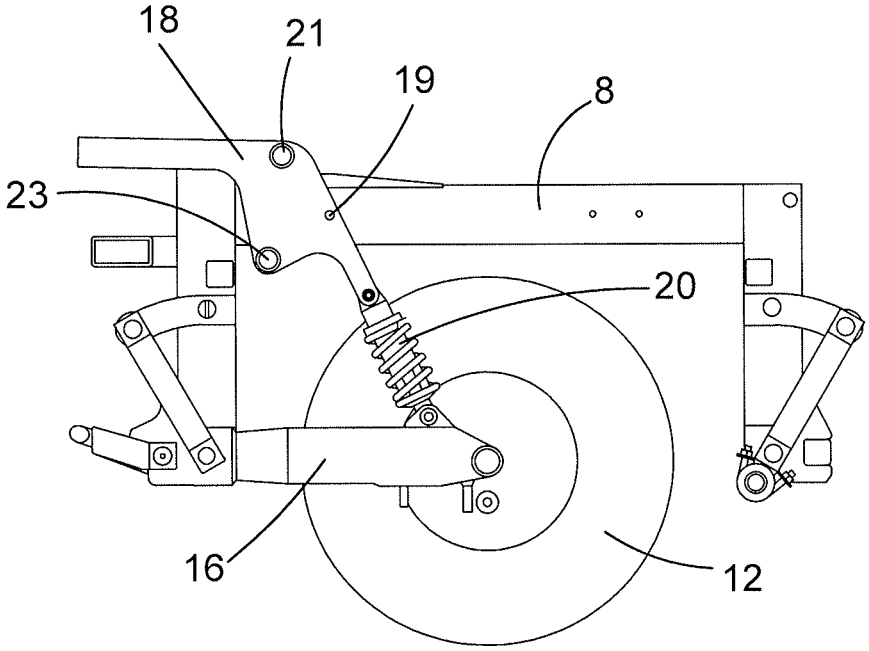
FIG. 5 is a side view of ground engaging wheels of the vehicle in a first mode.
Figure 6:
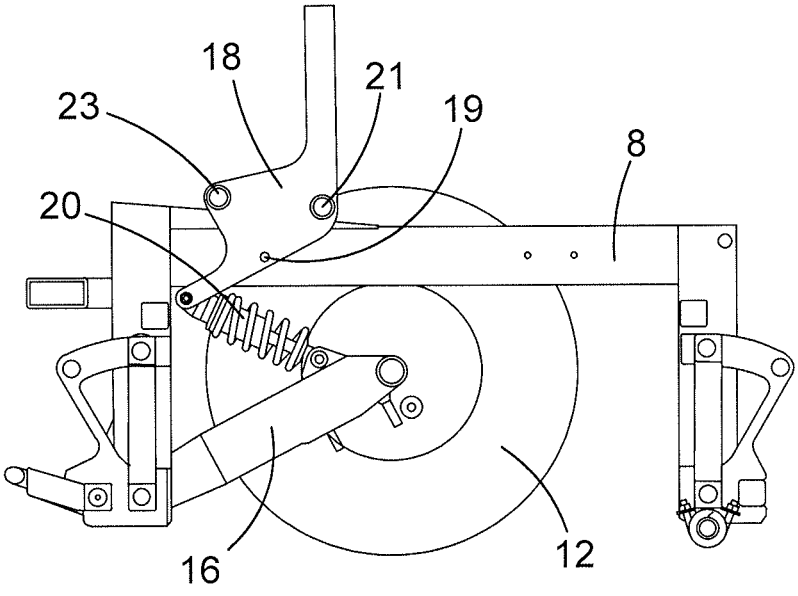
FIG. 6 is a side view corresponding to FIG. 5 of the wheels of FIG. 5 in a second mode.

As shown in greater detail in FIGS. 5 and 6, each of the transport wheels 12 is pivotably mounted to the vehicle frame 8 by means of a respective first strut 16 pivotably connected to the vehicle frame 8, a respective lever 18 pivotably mounted to the frame 8 at pivot 19 and to a suspension member 20 pivotably connected to the lever 18. Movement of the lever 18 between the positions shown in FIGS. 5 and 6 pivots the first strut 16 relative to the frame 8 to raise the wheel 12 relative to the frame 8. The lever 18 can be locked in the position shown in FIG. 5 by insertion of a pin (not shown) through aperture 21 on the lever 18 and through a corresponding aperture 17 (FIGS. 7 and 8) on the frame 8, and can be locked in the position shown in FIG. 6 by insertion of a pin (not shown) through aperture 23 on the lever 18 and through corresponding aperture 17 on the frame 8.

Figure 2:
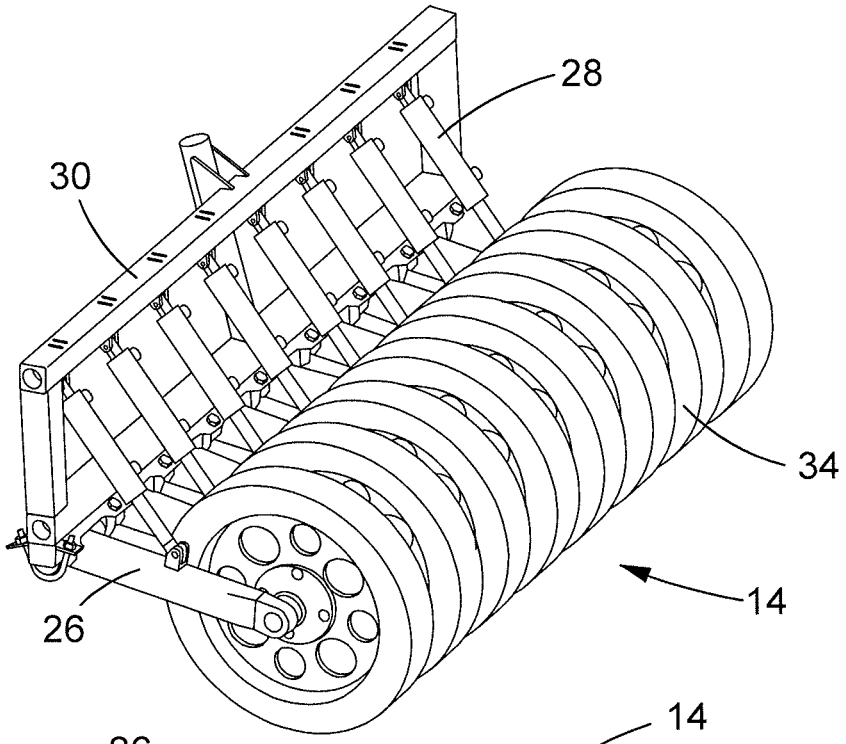
FIG. 2 is a perspective view of a roller assembly of the vehicle of FIG. 1.
Figure 7:
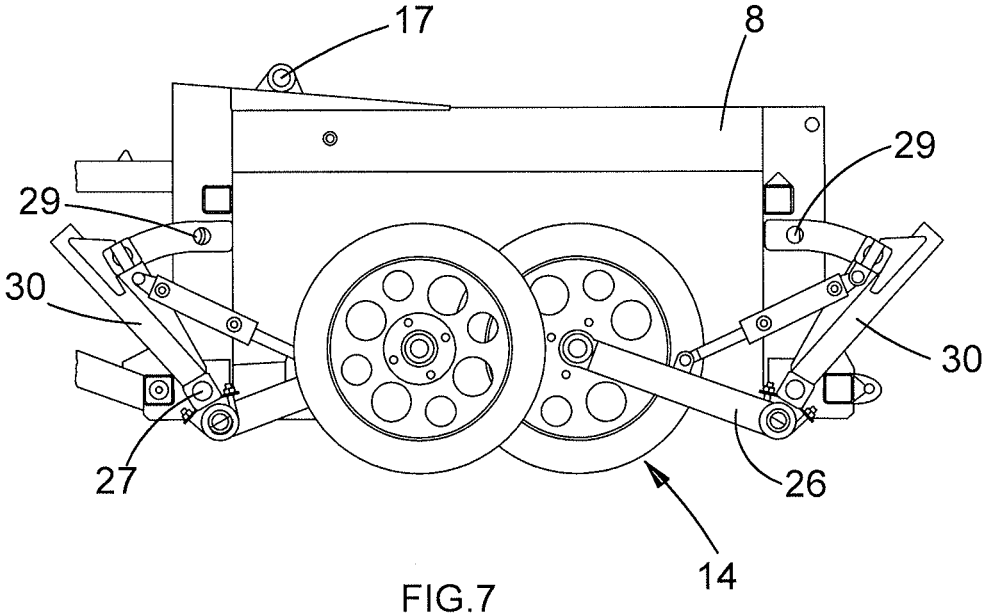
FIG. 7 is a side view of the pair of roller assemblies of FIG. 3 in the first mode.
Figure 8:
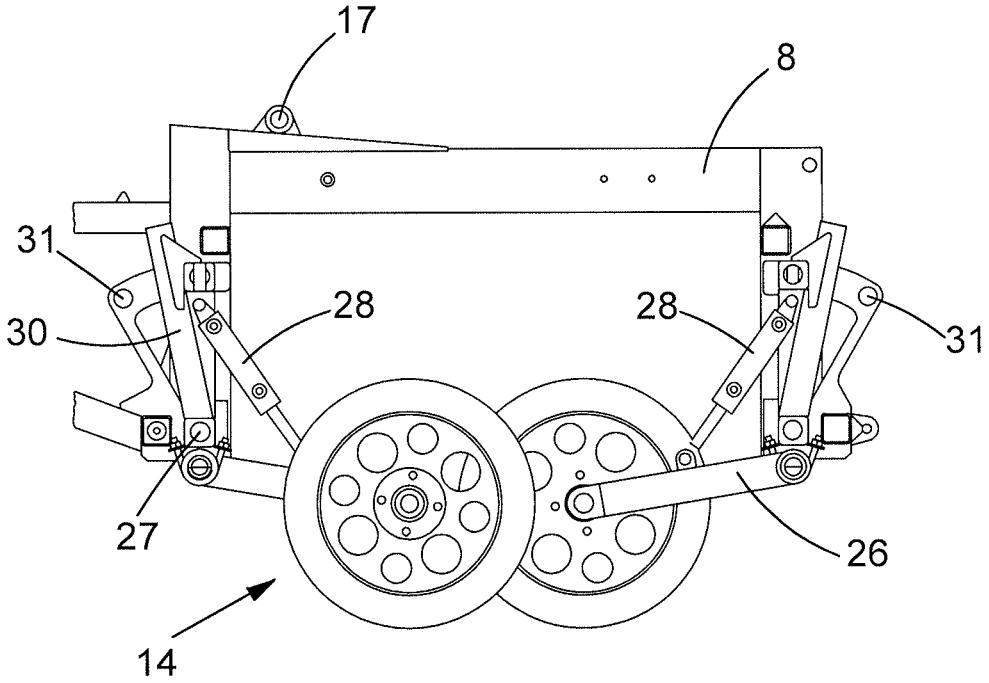
FIG. 8 is a view corresponding to FIG. 7 of the pair of roller assemblies in the second mode.

At the same time, and as shown in greater detail in FIGS. 2, 7 and 8, the ground engaging rollers 14 are mounted to the vehicle frame 8 such that each roller 34 of roller assemblies 14 is pivotably mounted via a respective second strut 26 to frame member 30 which is in turn connected to the vehicle frame 8 via pivot 27, and a respective piston 28 is connected between each second strut 26 and the frame member 30 to enable pivoting movement of the roller assembly 14 relative to the vehicle frame 8 as the vehicle 2 moves over uneven ground. Pivoting of the frame member 30 relative to the vehicle frame 8 about pivot 27 moves the roller assemblies 14 into and out of engagement with the ground, i.e. between the positions shown in FIGS. 7 and 8, and the frame member 30 can be secured in position relative to the vehicle frame 8 by means of suitable pins (not shown) inserted through aperture 25 in frame member 30 and holes 29 or 31 on vehicle frame 8.

Figure 3:
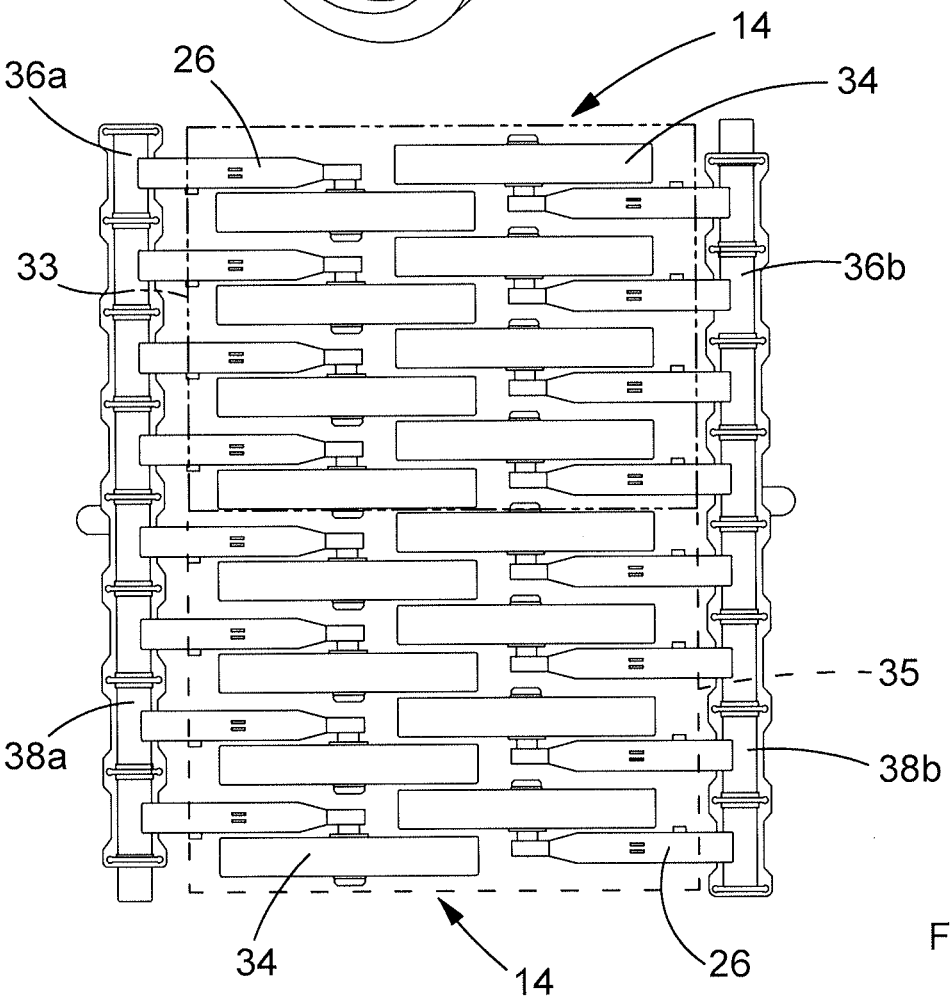
FIG. 3 is a view from above of a pair of roller assemblies of the vehicle of FIG. 1.
Figure 4:
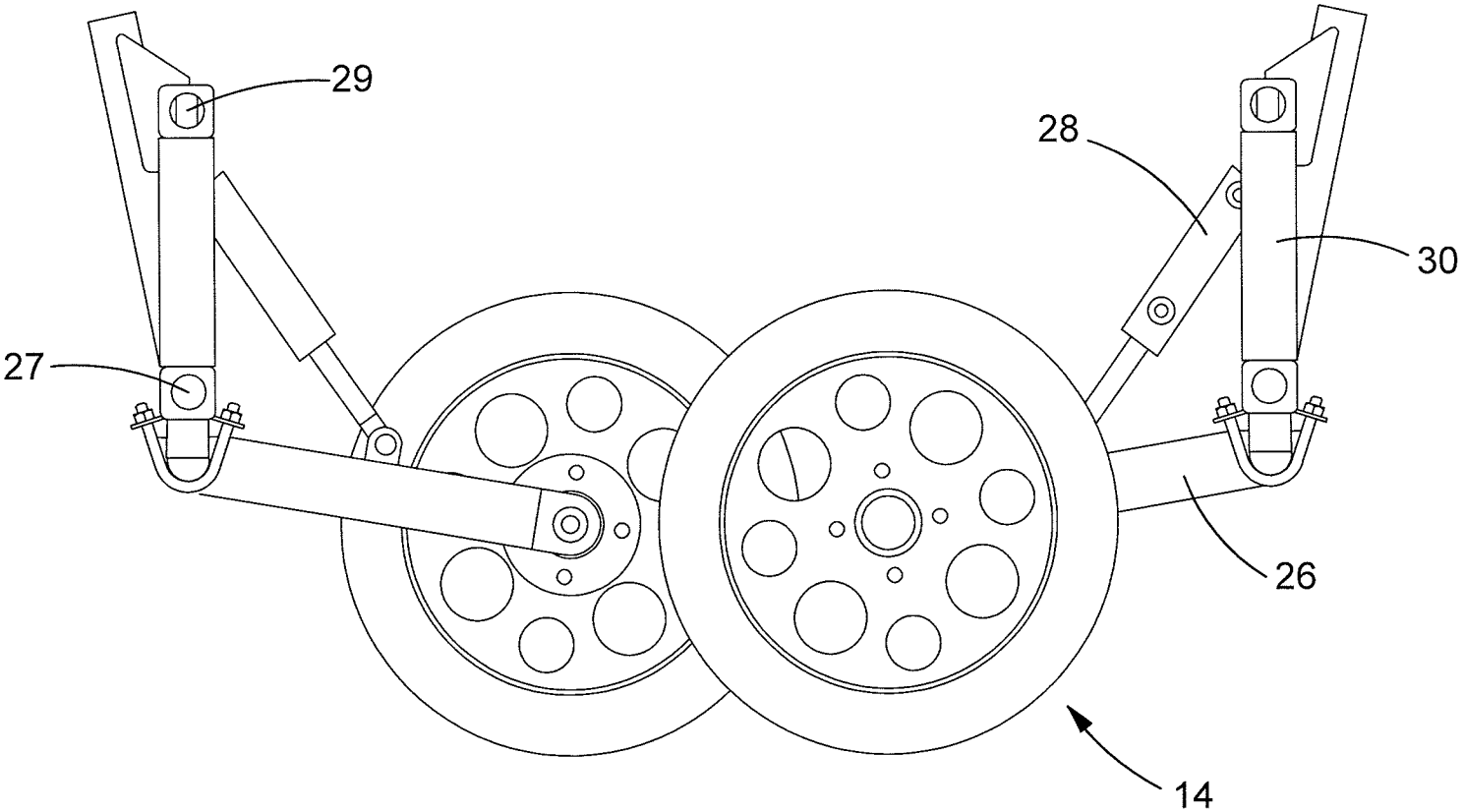
FIG. 4 is a side view of the pair of roller assemblies of FIG. 3.
Figure 9:
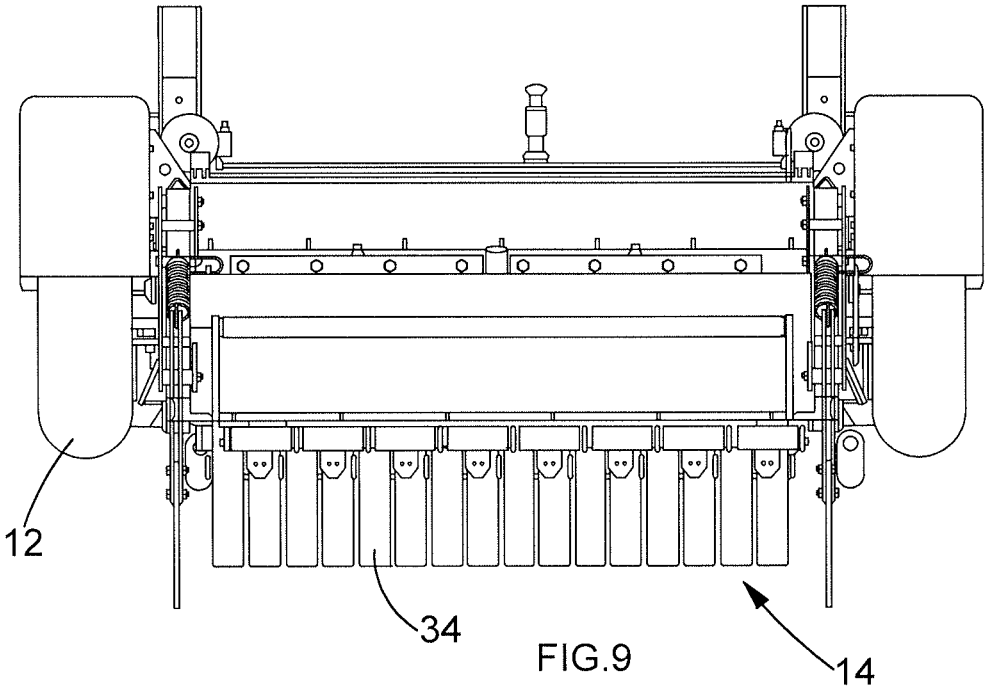
FIG. 9 is a rear view of the vehicle of FIG. 1 in the second mode.

As shown in greater detail in FIGS. 2, 3 and 9, each roller assembly 14 comprises a series of generally coaxial rollers 34 independently mounted to the corresponding frame member 30 by means of respective second struts 26 and pistons 28, such that rollers 34 of one roller assembly 14 partly protrude into gaps between rollers 34 of the other roller assembly 14. In this way, the rollers 34 of one roller assembly 14 substantially cover the gaps between the tracks covered by the rollers 34 of the other roller assembly 14, leaving a sufficiently small gap between rollers 34 to ensure that any explosive devices in the track covered by the combined roller assemblies 14 are detonated. The pistons 28 on one lateral side of the vehicle 2 (shown by box 33 in FIG. 3) are interconnected by a first hydraulic chamber 36*a* or 36*b* filled with liquid such as water or glycol to ensure minimum compressibility, and the pistons 28 on the other lateral side of the vehicle 2 (shown by box 35 in FIG. 3) are interconnected by a second hydraulic chamber 38*a* or 38*b*, similar to the first hydraulic chamber 36. The hydraulic chambers 36*a*, 36*b* are interconnected by means of a hydraulic line (not shown) arranged along an upper part of the vehicle frame 8 on one lateral side of the vehicle, and hydraulic chambers 38*a*, 38*b* are interconnected by means of a similar hydraulic line (not shown) arranged along an upper part of the vehicle frame 8 on the other lateral side of the vehicle. This minimises the risk of damage to the hydraulic lines in the event of an explosion.

Figure 10:
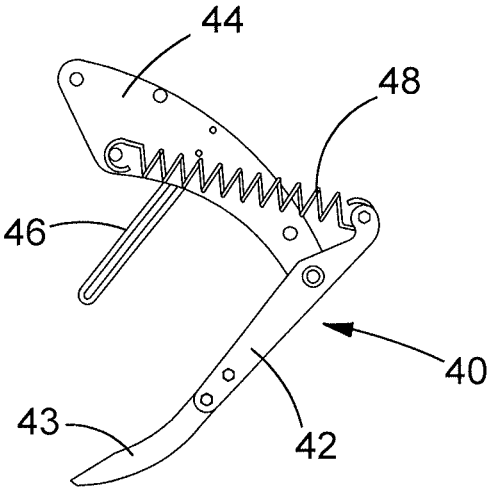
FIG. 10 is a detailed view of a command wire hook of the vehicle of FIG. 1 when the vehicle is reversing.
Figure 11:
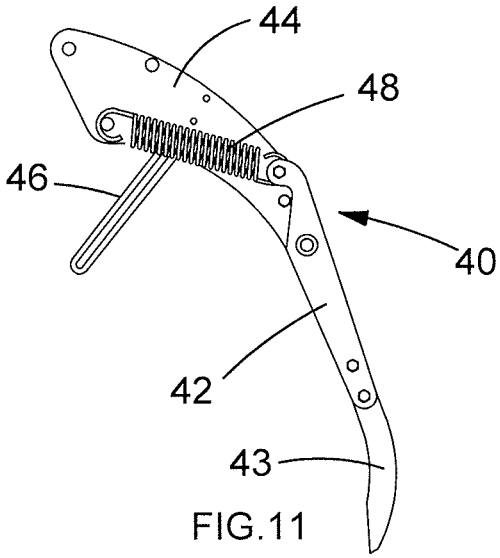
FIG. 11 is a side view of the command wire hook of FIG. 10 during normal operation of the vehicle.
Figure 12:
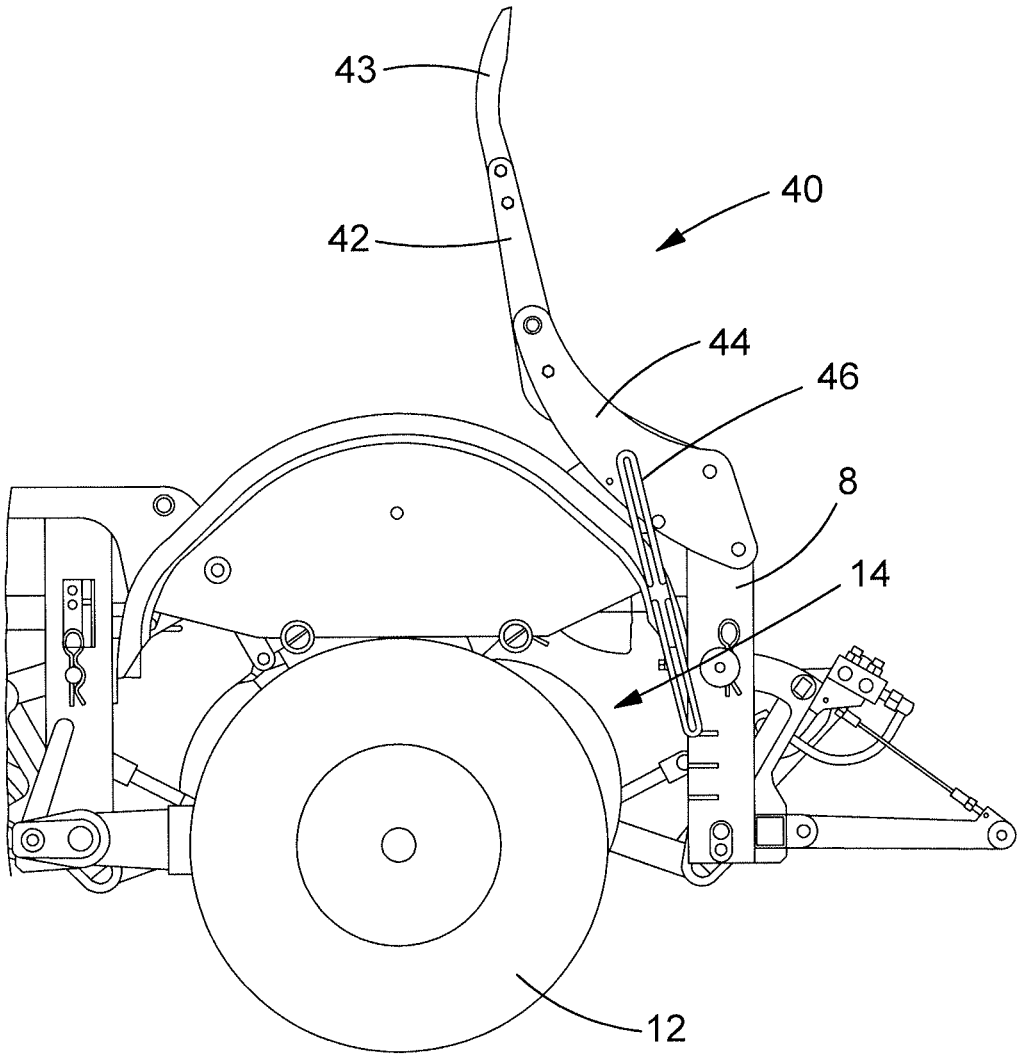
FIG. 12 is a side view of a rear part of the vehicle of FIG. 1 with the command wire hook in a raised position.

Referring to FIGS. 1 and 10 to 12, a pair of command wire hooks 40 are mounted to the rear of the vehicle frame 8. Each command wire hook 40 comprises a respective ground engaging member 42 having a replaceable tip 43 and pivotably mounted to a first support member 44 which is in turn pivotably mounted to the frame 8 and biased towards the ground by means of a first tension spring 46 such that the ground engaging member 42 is urged into engagement with the ground with sufficient force to engage and expose and/or disable any command wires (not shown), and to leave a visible trace to enable personnel travelling on foot a safe distance behind the vehicle 2 to locate the safe track created by the roller assemblies 14 and command wire hooks 40. The ground engaging members 42 can pivot relative to the corresponding support members 44 against the action of respective second tension springs 48, and can trail along the ground with minimum force when the vehicle is reversed, as shown in FIG. 10.

The operation of the vehicle 2 will now be described.

In regions where the risk of encountering explosive devices is low, rapid movement of the vehicle 2 is possible in the first mode by bringing the transport wheels 12 into engagement with the ground and disengaging the roller assemblies 14 from the ground. In the first mode, the command wire hooks 40 are also disengaged from the ground, since their operation is less necessary, by pivoting the first support members 44 about the vehicle frame 8 to the orientation shown in FIG. 12, and are maintained in that orientation by respective first tension springs 46. In the first mode, personnel may be travelling in the towing vehicle (not shown).

In the event of encountering a region where there is increased risk of explosive devices, the vehicle 2 is converted to the second mode by raising the transport wheels 12 relative to the vehicle frame 8 to bring the transport wheels 12 out of engagement with the ground and lowering the roller assemblies 14 to bring the roller assemblies 14 into engagement with the ground. At the same time, the command wire hooks 40 are biased into engagement with the ground by pivoting the first support members 44 about the vehicle frame 8 into the orientation shown in FIGS. 1 and 11. The personnel previously travelling in the towing vehicle them exit the towing vehicle, and the towing vehicle is operated by remote control to tow the vehicle 2 across ground where the existence of explosive devices may be suspected. As the vehicle 2 travels forwards, any explosive devices in the track covered by the roller assemblies 4 are detonated, and any command wires below the ground surface are engaged by the command wire hooks 40 and made visible and/or disabled. At the same time, the lateral extent of the track cleared by the roller assemblies 14 and command wire hooks 40 is made visible by the command wire hooks 40 so that personnel walking a safe distance behind the vehicle 2 can recognise the safe track cleared by the vehicle 2.

It will be appreciated by person skilled in the art that the above embodiment has been described by way of example only, and not in any limitative sense, and that various alterations and modifications are possible without departure from the scope of the invention as defined by the appended claims. For example, the vehicle can be pushed by a pushing vehicle, rather than towed by a towing vehicle, and ballast other than sand bags 10 can be used, although sand bags have the advantage that earth or sand can be used as ballast and the ballast therefore does not have to be permanently carried with the vehicle 2. Also, first ground engaging means other than transport wheels 12 can be used, for example tracks.

The invention claimed is:

1. A vehicle comprising:

a vehicle body;

at least one first ground engaging device, adapted to support the vehicle body in a first mode of operation of the vehicle;

at least one second ground engaging device, adapted to support the vehicle body and apply pressure to the ground to detonate explosive devices in a second mode of operation of the vehicle; and at least one support device mounted to the vehicle body for supporting at least one said first ground engaging device and at least one said second ground engaging device;

wherein at least one said support device is adapted to cause at least one said first ground engaging device to engage the ground and at least one said second ground engaging device to be out of engagement with the ground in said first mode, and at least one said second ground engaging device to engage the ground and at least one said first ground engaging device to be out of engagement with the ground in said second mode, and wherein at least one said second ground engaging device comprises at least one first row of ground engaging members and at least one second row of ground engaging members, and at least one ground engaging member of at least one said first row at least partly protrudes into a gap between a plurality of ground engaging members of a respective said second row.

2. The vehicle of claim 1, wherein at least one said support device is adapted to raise at least one said first ground engaging device relative to the vehicle body and/or relative to at least one said second ground engaging device.

3. The vehicle of claim 2, wherein at least one said support device comprises at least one first support member adapted to be pivotably mounted relative to the vehicle body and to at least one said first ground engaging device.

4. The vehicle of claim 1, wherein at least one said support device is adapted to raise at least one said second ground engaging device relative to the vehicle body and/or relative to at least one said first ground engaging device in use.

5. The vehicle of claim 4, wherein at least one said support device further comprises at least one second support member adapted to be pivotably mounted relative to the vehicle body and to at least one said second ground engaging device.

6. The vehicle of claim 1, wherein at least one said support device further comprises at least one piston for connecting at least one said second ground engaging device to the vehicle body and allowing movement of at least one said second ground engaging device relative to the vehicle body.

7. The vehicle of claim 6, wherein at least one said support device comprises a plurality of said pistons interconnected by at least one chamber adapted to contain liquid, wherein a plurality of said pistons are adapted to connect at least one respective ground engaging member of at least one said second ground engaging device to said vehicle body.

8. The vehicle of claim 7, wherein at least one first plurality of said pistons on a first side of said vehicle is interconnected by at least one respective first said chamber, and at least one second plurality of said pistons on a second side of said vehicle is interconnected by at least one respective second said chamber.

9. The vehicle of claim 1, wherein at least one plurality of said chambers is interconnected by at least one hydraulic interconnection device arranged in use on an upper part of said vehicle body.

10. The vehicle of claim 1, further comprising at least one third ground engaging device adapted to engage one or more wires extending laterally across the path of the vehicle.

11. The vehicle of claim 10, wherein at least one said third ground engaging device is adapted to leave a visible trace as a result of engagement with the ground.

12. The vehicle of claim 10, wherein at least one said third ground engaging device is displaceable relative to the vehicle body and is biased into engagement with the ground in use.

13. The vehicle of claim 10, wherein at least one said third ground engaging device comprises at least one first ground engaging member moveable relative to the vehicle body from a first position to a second position as a result of reversal of the direction of travel of the vehicle, wherein the first ground engaging member causes a smaller resistance to movement of the vehicle in said second position than in said first position.

14. The vehicle of claim 13, wherein at least one said third ground engaging device comprises at least one support member and at least one respective said first ground engaging member pivotably mounted to at least one said support member.

* * * * *